US011610444B2

(12) United States Patent
Schrems

(10) Patent No.: US 11,610,444 B2
(45) Date of Patent: Mar. 21, 2023

(54) MOVABLE BARRIER OPERATOR SYSTEM HAVING AN IMMINENT MOTION NOTIFICATION APPARATUS

(71) Applicant: The Chamberlain Group LLC, Oak Brook, IL (US)

(72) Inventor: Adam Joshua Schrems, Highland Park, IL (US)

(73) Assignee: The Chamberlain Group LLC, Oak Brook, IL (US)

( * ) Notice: Subject to any disclaimer, the term of this patent is extended or adjusted under 35 U.S.C. 154(b) by 0 days.

(21) Appl. No.: 17/549,317

(22) Filed: Dec. 13, 2021

(65) Prior Publication Data

US 2022/0198857 A1 Jun. 23, 2022

Related U.S. Application Data

(60) Provisional application No. 63/128,919, filed on Dec. 22, 2020.

(51) Int. Cl.

| | |
|---|---|
| ***G07C 9/00*** | (2020.01) |
| ***E05F 15/668*** | (2015.01) |
| ***E05F 15/77*** | (2015.01) |

(52) U.S. Cl.

CPC ..... *G07C 9/00896* (2013.01); *E05F 15/668* (2015.01); *E05F 15/77* (2015.01); *G07C 9/00182* (2013.01); *E05Y 2400/80* (2013.01); *E05Y 2900/106* (2013.01); *G07C 2009/00928* (2013.01)

(58) Field of Classification Search

None

See application file for complete search history.

(56) References Cited

U.S. PATENT DOCUMENTS 6,476,732 B1 11/2002 Stephan
6,856,820 B1 2/2005 Kolls (Continued)

OTHER PUBLICATIONS

LiftMaster—UL 325 Standards & Compliance; Safety & Security; https://www.liftmazster.cvom/about-liftmaster/safety 17 Pages, Dated Dec. 16, 2020.

(Continued)

*Primary Examiner* — K. Wong

(74) *Attorney, Agent, or Firm* — Fitch, Even, Tabin & Flannery LLP

(57) ABSTRACT

In one aspect, a remote server computer is provided for facilitating operation of movable barrier operator systems having imminent motion notification apparatuses. The remote server computer includes a processor, a memory, and a network interface for communicating state change commands to the movable barrier operator systems via a network. The remote server computer is configured to receive a confirmation indicating that a sensor check has been performed to test sensors of those systems. Upon receiving a state change request from a remote control associated with a movable barrier operator system, the processor may determine whether the confirmation has been received for that system, and if so, causes communication of an attended command signal that inhibits operation of an imminent motion notification apparatus of the movable barrier operator system. Otherwise, the remote server computer may communicate an unattended command signal.

26 Claims, 9 Drawing Sheets

(56) References Cited

U.S. PATENT DOCUMENTS

| | | | | |
|---|---|---|---|---|
| 7,272,497 | B2 | 9/2007 | Koshiji | |
| 7,532,965 | B2 | 5/2009 | Robillard | |
| 10,837,217 | B2 * | 11/2020 | Cate ..... | G07C 9/00182 |
| 10,873,828 | B2 | 12/2020 | Lau | |
| 2003/0055557 | A1 | 3/2003 | Dutta | |

OTHER PUBLICATIONS

Non-Patent Literature Document Disclosing YouTube Video entitled "How to do a Garage Door Safety Test" https://www.youtube.com/watch?v=Z31AB1ilygo; published May 3, 2013; 10 pages; Disclosing Screen Captures and Audio Transcription.

UL Standard for Safety for Door, Drapery, Gate, Louver, and Window Operators and Systems, UL 325 Fifth Edition, Dated Jun. 7, 2002; pp. 1-186.

* cited by examiner

MOVABLE BARRIER OPERATOR SYSTEM HAVING AN IMMINENT MOTION NOTIFICATION APPARATUS

CROSS-REFERENCE TO RELATED APPLICATION

This application claims the benefit of U.S. Provisional Patent App. No. 63/128,919 filed Dec. 22, 2020, which is hereby incorporated by reference herein in its entirety.

FIELD

This disclosure relates generally to movable barrier operator systems having imminent motion notification apparatuses, more specifically, to movable barrier operator systems having selectively operable imminent motion notification apparatuses.

BACKGROUND

Movable barrier operators for controlling various types of barriers such as garage doors, gates, and the like are well known in the art. Some users operate these movable barrier operators using a local remote control, such as a handheld transmitter, to send a command message to open or close a movable barrier. Movable barrier operators may also receive command messages from a remote server computer via the internet in response to receiving a state change request from a remote device to allow for remote operation by a user. For example, a user may control a movable barrier operator through a website accessed by a computing device or via an application installed on the user's smartphone.

When a user operates a movable barrier operator using a remote device via a network, such as the internet, the operation is typically classified as an unattended operation. Given the potential distance between the user operating a movable barrier operator through a remote device and the movable barrier itself, the user may be unaware of any individuals or pets located near the movable barrier prior to an open or close operation. In such systems, an unattended operation initiated by a remote device includes an imminent motion notification apparatus of the movable barrier operator outputting an imminent motion notification during a delay in operation, and the movable barrier operator moving the movable barrier after expiration of the delay. The imminent motion notification may be at least one of a flashing light and a sound alert to warn nearby individuals that the movable barrier will open or close.

Additionally, if a user operates a movable barrier using a local transmitter, the operation is classified as an attended operation which does not entail an imminent motion notification. Given the typically short radio range of a local transmitter, an imminent motion notification is generally thought to be unnecessary because the user is likely in view of the movable barrier when actuating the transmitter.

However, such methods do not account for the possibility that a user may operate the movable barrier operator when the user is near the movable barrier using a remote device via a network, which would typically require an imminent motion notification. For example, a user may attempt to open or close a garage door using a smartphone or vehicle infotainment system while in a driveway, or inside the associated garage. In these situations, the movable barrier operator system would automatically classify the operation as an unattended close (because the request to open or close the movable barrier was received via a network) such that one or more of delayed operation of the movable barrier operator, flashing a light, and generating a sound alert occur, which may result in frustration by or inconvenience to a user because the light and/or sound notification is not required.

Further, a delivery associate may attempt to deliver a package intended for the user within a user's garage using a portable electronic delivery device (e.g., the delivery associate's phone or tablet), but the request to move the movable barrier is likewise received via the network and typically classified as an unattended close. As a result, the request to access the garage to deliver the package would cause an imminent motion notification, thus requiring the delivery associate to wait for expiration of the delay and/or the notification to finish thereby increasing the amount of time to deliver the package.

Elements in the figures are illustrated for simplicity and clarity and have not necessarily been drawn to scale. For example, the dimensions and/or relative positioning of some of the elements in the figures may be exaggerated relative to other elements to help to improve understanding of various embodiments of the present teachings. Also, common but well-understood elements that are useful or necessary in a commercially feasible embodiment are often not depicted in order to facilitate a less obstructed view of these various embodiments of the present teachings. Certain actions and/or operations may be described or depicted in a particular order of occurrence while those skilled in the art will understand that such specificity with respect to sequence is not intended to be limiting.

DETAILED DESCRIPTION

Figure 1:
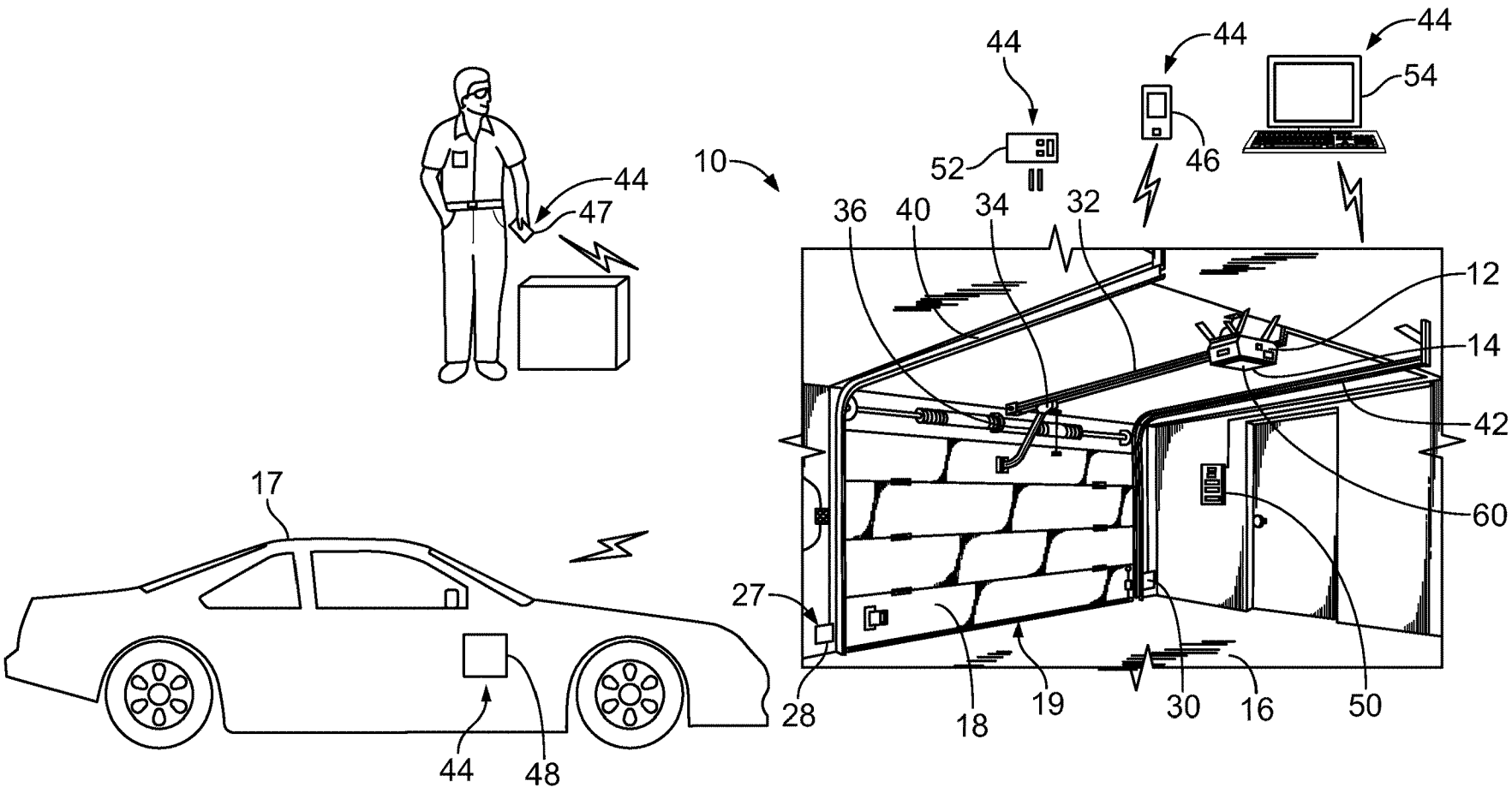
FIG. 1 is a perspective view of an example movable barrier operator system in communication with various types of remote controls.

Referring now to the drawings, and more particularly FIG. 1, an example movable barrier operator system 10 is shown including a movable barrier operator 12 and a moving-barrier imminent motion notification apparatus 14. The movable barrier operator 12 is shown mounted to the ceiling of a garage 16 and controls the movement and position of a movable barrier 18. Regarding FIG. 2, the example movable barrier operator 12 includes a motor 20, communication circuitry 22, and a controller 24, and may further include or be operably coupled to one or more sensors 27 such as an optical sensor 26 including an optical emitter 28 and an optical detector 30 (see FIG. 1), and a force reversal sensor 31 as described in further detail below. The movable barrier operator system 10 may include a rail 32 and trolley 34. The trolley 34 has an arm 36 that is connected to the movable barrier 18. A coupling such as a belt or chain connects the trolley 34 to an output (e.g., a drive shaft or transmission) of the motor 20. The movable barrier 18 is positioned for movement along a pair of door tracks 40, 42 in a path of travel. In response to receiving a state change command, the movable barrier operator 12 changes the state of the movable barrier 18. For example, the movable barrier operator 12 moves the movable barrier 18 from an open position to a closed position, or vice versa, upon receipt of a command. Although the movable barrier operator 12 is shown in FIG. 1 as a trolley-type garage door opener, nevertheless the systems and methods of the present disclosure may be employed with other movable barrier operators such as, for example, a jackshaft-type operator.

The communication circuitry 22 (see FIG. 2) of the movable barrier operator 12 is configured to communicate with one or more remote controls 44, and may also be configured to communicate with a remote device via a network, such as the internet. The one or more remote controls 44 may include, for example, a portable electronic device 46 of a user (which may be a portable user device such as a smartphone, tablet computer, smartwatch, smart eyeglasses, and/or a smart wearable), a portable electronic device of a delivery associate 47, a vehicle integral (e.g., HomeLink®-style) transmitter 48, a wall-mounted keypad 50, a handheld RF transmitter 52, a remote computer 54 (such as a desktop or laptop), or a security system associated with the garage 16. The one or more remote controls 44 are configured to communicate either directly or indirectly with the movable barrier operator 12 to effect a change of the state of the movable barrier 18. The remote controls 44 may send a communication such as a "rolling" code (e.g., Security+2.0® of The Chamberlain Group LLC) that includes for example: an identifier portion to identify the remote control 44 sending the communication and/or a variable portion that changes with each communication sent by the remote control 44. For example, the handheld transmitter 52 may send a communication directly to the movable barrier operator 12 that may be a radio frequency signal including a command message having an identifier portion and a variable portion.

The remote controls 44 may communicate directly with the movable barrier operator 12, such as with radio frequency signals as described above. Additionally or alternatively, one or more of the remote controls 44 may be configured to communicate with the movable barrier operator 12 via a wired approach (see, for example, wall control keypad 50 shown in FIG. 1). Furthermore, one or more of the remote controls 44 may be in indirect communication with the movable barrier operator 12 such as via a network 56 and a server computer 58 (see FIG. 2). The network 56 may include a wired or wireless network (or a combination thereof), and may include one or more networks, for example, at least one long-range network such as a cellular network, a short-range network such as a Wi-Fi network, and the internet. For instance, although the handheld transmitter 52 may communicate directly with the movable barrier operator 12 via radio frequency signals thus limiting its range, the portable electronic device 46, such as a user's smartphone, may instead communicate indirectly with the movable barrier operator 12 to effectively increase the range of operation. Specifically, the portable electronic device 46 communicates a state change request to the server computer 58 via the network 56, and if the portable electronic device 46 is authorized to communicate with the movable barrier operator 12, the server computer 58 communicates a state change command to the movable barrier operator 12 via the network 56. Similarly, the portable electronic device 47 of a delivery associate, the computer 54, or a security system may communicate indirectly with the movable barrier operator 12 via the network 56 and the server computer 58 in a similar manner. Upon receiving the state change command, whether directly or indirectly, the movable barrier operator 12 changes the state of the movable barrier 18.

The movable barrier operator 12 may additionally be configured to communicate with one or more peripheral devices. For example, the communication circuitry 22 of the movable barrier operator 12 may include various wired or wireless connections to communicate with other devices, and the communication circuitry 22 may be configured to receive information from the one or more sensors 27 associated with the movable barrier 12 such as the optical sensor 26 (e.g., the optical emitter 28 and optical detector 30 in FIG. 1) and force reversal sensor 31 to determine if any obstructions are detected in the path of travel of the movable barrier 18. The communication circuitry 22 may likewise include antennae or other communication hardware to communicate with a WiFi router or access point, other remote sensors, or other devices.

During installation of the movable barrier operator 12, a user may electronically pair the user's portable electronic device 46 to the movable barrier operator 12 to facilitate an initial setup procedure. The initial setup procedure may include the user device 46 communicating network credentials to the communication circuitry 22 of the movable barrier operator 12, and the controller 24 storing the credentials in a memory 25, such that the movable barrier operator 12 may be configured to wirelessly communicate via, for example, the network 56 over the internet. For example, the credentials may include a local Wi-Fi network name and password. So configured, the movable barrier operator 12 may be configured to wirelessly communicate with the user device 46 and to receive state change commands from the remote server computer 58 via the network 56.

Regarding FIG. 1, the imminent motion notification apparatus 14 is integrated with the movable barrier operator 12 on the ceiling of the garage 16 and is not a separate component. The imminent motion notification apparatus 14 may alternatively or additionally be separate or distinct from the movable barrier operator 12 and located in other areas proximate the movable barrier 18, such as a wall of the garage 16 or on the ceiling of the garage 16. Generally, the imminent motion notification apparatus 14 is configured to provide a notification, alert, warning, etc. to nearby individuals or pets that the movable barrier 18 will imminently move in order to thereby reduce potential surprise associated with the movement.

Upon the movable barrier operator 12 receiving a state change command from the remote server computer 58, the imminent motion notification apparatus 14 is typically configured to provide an imminent motion notification that includes a visual alert, a sound alert, a partial movement of the barrier, or a combination thereof, followed by or concurrent with delayed movement of the movable barrier 18. In one embodiment, the controller 24 of the movable barrier operator 12 initiates a timer to delay operation of the motor 20 for a short period of time upon receiving the state change command from the server computer 58, for example, five seconds or more before a change of state of the movable barrier 18. Additionally, the imminent motion notification apparatus 14 may include an acoustic transducer such as a speaker 15 of the movable barrier operator 12 for emitting an audible alert for a short period of time, for example, five seconds or more before a change of state of the movable barrier 18. For example, the audible alert may include a continuous high-pitched tone, an intermittent beeping, a pre-recorded message, or the like, that may be heard by nearby individuals. The imminent motion notification apparatus 14 may include an overhead light 60 of the movable barrier operator 12 and the imminent motion notification apparatus 14 provides a visual alert by illuminating the overhead light 60 of the movable barrier operator 12. For example, the visual alert may include flashing or strobing the overhead light 60 for a short period of time, for example, five seconds or more before a change of state of the movable barrier 18. So configured, the imminent motion notification apparatus 14 provides an imminent motion notification to alert individuals near the movable barrier 18 prior to a change of state operation.

Figure 2:
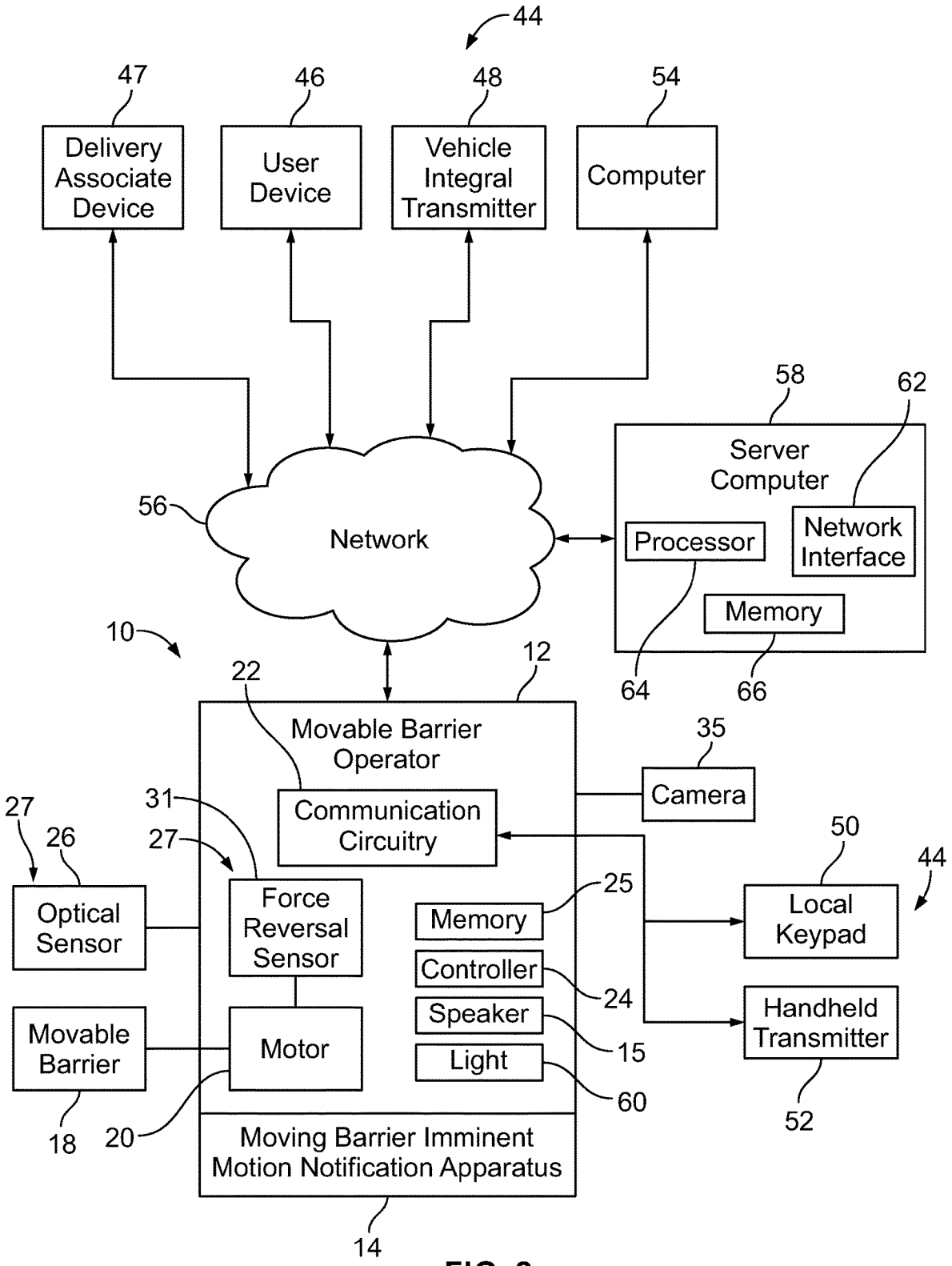
FIG. 2 is a block diagram of the movable barrier operator system of FIG. 1 showing a movable barrier operator, a moving-barrier imminent motion notification apparatus, and a remote server computer communicatively coupled via a network.

Regarding FIGS. 1 and 2, the movable barrier operator system 10 moves the movable barrier 18 with or without operation of the imminent motion notification apparatus 14 based at least in part on whether a particular type of remote control 44 has been actuated. For example, in typical operation, a state change command received from a local remote control (e.g., the handheld transmitter 52) is configured to cause movement of the movable barrier 18 without operation of the imminent motion notification apparatus 14 since it is assumed that the user of the local remote control is proximate the movable barrier 18 due to the limited range of such transmitters. In contrast, a state change command received indirectly from a remote control through the remote server computer 58 (e.g., originating from a portable electronic device 46, 47 or vehicle integral transmitter 48) is configured to cause movement of the movable barrier 18 in connection with operation of the imminent motion notification apparatus 14 since it is unclear whether the user is proximate the movable barrier 18 (i.e., because such remote controls may be able to communicate a request to open or close the movable barrier 18 from anywhere via the internet). Even if the user is proximate the movable barrier 18, such as waiting in a driveway associated with the garage 16, a request to open or close the movable barrier 18 from the user's portable electronic device 46 or another remote control that communicates indirectly with the movable barrier operator 12 would traditionally require operation of the imminent motion notification apparatus 14 even though a delay may not be required.

As provided herein, the remote server computer 58 communicates different types of state change commands for causing operation, or inhibiting operation, of the imminent motion notification apparatus 14, based at least in part on a determination of whether a sensor check or inspection has been performed for the movable barrier operator system 10. For example, if a sensor check has been completed, the remote server computer 58 is configured to communicate an attended state change command (as opposed to an unattended state change command), which is indicative of various features of the movable barrier operator system 10 having been tested and are operating correctly, to the movable barrier operator 12 to inhibit or bypass operation of the imminent motion notification apparatus 14 (e.g., by not effecting operation of some or all aspects of an imminent motion notification), as described in further detail below, so as to reduce potential frustration caused by the delay associated with an imminent motion notification. In some forms, the determination of whether a sensor check or inspection has been performed for the movable barrier operator system may be executed by one or a combination of the remote server computer 58, the movable barrier operator 12, and the remote control 44.

As shown in FIG. 2, the remote server computer 58 for facilitating operation by the remote controls 44 of the movable barrier operator system 10 includes a network interface 62, a processor 64, and a memory 66. The memory 66 comprises a non-transitory computer-readable medium that may be configured to store, for example, information related to a plurality of different movable barrier operators 12 and associated remote controls 44. In one form, the memory 66 of the server computer 58 also stores information associated with a plurality of user accounts associated with users of different movable barrier operator installations. Such user accounts may include information related to different movable barrier operators owned or used by each user, preferences, detected obstructions or errors, and account information associated with a mobile phone application for facilitating use of the movable barrier operators, as described in further detail below.

The processor 64 of the remote server computer 58 may be configured to execute computer-readable instructions stored on the memory 66. The network interface 62 is configured to communicate with the various client applications or devices that constitute the movable barrier operator system 10 such as the movable barrier operator 12 and the remote controls 44 via the network 56, such as the internet or a local area network, and may also receive a state change request from some remote controls 44, such as the portable electronic device 46. When the network interface 62 receives a state change request from one of the remote controls 44 associated with a particular movable barrier operator 12, the processor 64 is configured to cause the network interface 62 to communicate a message or signal regarding the state change command to the movable barrier operator 12 of that system 10.

The processor 64 may be configured to cause communication of different types of state change commands for effecting different operations of the movable barrier operator system 10. For example, the processor 64 may be configured to cause the network interface 62 to communicate either an attended state change command or an unattended state change command based at least in part on a determination of whether a sensor check has been completed to test functionality and operation of various sensors associated with a specific movable barrier operator system. An example sensor check method to be performed (including various example testing protocols and prompts and/or instructions thereof) is described in further detail hereinafter with respect to FIGS. 4 and 7-13. An indication, such as a flag set on a user's account, may be stored in the memory 66 of the remote server computer 58 to indicate whether a sensor check has been performed for a respective movable barrier operator system 10 associated with a specific user account. Additionally or alternatively, the indication that the sensor check(s) have been completed to test functionality and operation of various sensors associated with a specific movable barrier operator system may be stored in a memory of the remote control 44 and/or in a memory of the movable barrier operator 12.

Upon a determination by the processor 64 that a sensor check was performed successfully for a specific movable barrier operator 12, as noted by the indication such as a flag set on the user account stored in the memory 66 (or alternatively, as indicated by a signal received from the remote control 44 and/or movable barrier operator 12 indicating that the sensor check was performed successfully), the processor 64 causes the network interface 62 to communicate an attended state change command configured to effect a change in state of the movable barrier 18 without causing operation of the imminent motion notification apparatus 14 in response to receiving a state change request. Otherwise, the processor 64 after checking the memory 66 and determining an absence (or staleness—indicative of the sensor check not being performed within a threshold period of time) of the indication/flag causes communication of an unattended state change command configured to effect a change in state of the movable barrier 18 in combination with operation of the moving-barrier imminent motion notification apparatus 14 to alert individuals proximate the movable barrier.

Additionally or alternatively, in an embodiment where the indication that the sensor check has been completed is stored in the memory of the remote control 44, a processor of the remote control 44 may be configured to determine whether the sensor check has been performed successfully for a specific movable barrier operator 12, as noted by the indication stored in the memory, and may be configured to communicate, in connection with a state change command, a signal to the remote server computer 58 and/or the movable barrier operator 12 indicating that the sensor check either has or has not been performed. In some forms, a signal indicating that the sensor check has been performed may be configured to inhibit operation of the moving-barrier imminent motion notification apparatus 14 and a signal indicating that the sensor check has not been performed may be configured to cause operation of the moving-barrier imminent motion notification apparatus 14 in connection with a change of state of the movable barrier.

In still further forms where the indication that the sensor check has been completed is stored in the memory 25 of the movable barrier operator 12, the remote server computer 58 and/or the remote control 44 may be configured to communicate a state change command to the movable barrier operator 12 and the controller 24 may be configured to determine whether the sensor check has been performed successfully for that movable barrier operator 12. In such embodiments, upon a determination that the sensor check has been performed successfully based on the indication stored in the memory 25, the controller 24 may refrain from causing operation of an imminent motion notification, and upon a determination that the sensor check has not been performed successfully, the controller 24 may cause operation of an imminent motion notification in connection with a change of state of the movable barrier.

So configured, a user or owner of the movable barrier operator system 10 may be permitted to inhibit, prevent, or bypass operation of the imminent motion notification apparatus 14 in connection with movement of the movable barrier 18 based at least in part on the sensor check being performed to test and ensure sensors associated with the movable barrier operating system 10 (e.g., optical sensor 26 and force reversal sensor 31) are properly functioning. If the sensors associated with the movable barrier operator system 10 are confirmed to be functioning properly, the imminent motion notification apparatus 14 may not be actuated when using a remote control 44 that communicates directly and/or indirectly with the movable barrier operator 12 via the remote server computer 58 such that the user is not required to wait for the delay associated with an imminent motion notification when the movable barrier 18 is opened or closed.

Referring again to FIG. 2, various sensors 27 associated with the movable barrier operator system 10 include an optical sensor 26, such as an optical emitter 28 and an optical detector 30 (see FIG. 1), and a force reversal sensor 31. In operation, these sensors 27 facilitate operation of the movable barrier operator system 10 by either inhibiting the movable barrier 18 from opening or closing, or reversing movement thereof, when obstructions or excessive forces are detected during movement of the movable barrier 18. In one embodiment, the movable barrier operator system 10 may include a jackshaft operator and the sensors 27 include a device or apparatus configured to monitor or sense the tension in one or more cables connected to the movable barrier 18 that facilitate lifting and lowering thereof.

The optical sensor 26 is configured to detect the presence of potential obstructions in the path of travel of the movable barrier 18 between the open position and the closed position. For example, in an embodiment including the optical emitter 28 and optical detector 30, an obstruction may be detected based at least in part on the optical detector 30 failing to detect a light beam emitted from the optical emitter 28 across an opening 19 of a garage 16 (see FIG. 1). If an obstruction is detected during the closing of the movable barrier 18, the controller 24 of the movable barrier operator 12 is configured to stop and/or reverse movement of the movable barrier 18. Other forms of optical sensors may likewise be used in connection with the movable barrier operator system 10, such as one or more cameras that are configured to use image recognition to determine if any objects or obstructions are present in the path of travel of the movable barrier 18. Such example optical sensors 26 may be used either alone or in combination with one another.

Similarly, the force reversal sensor 31 is configured to detect a force applied to the movable barrier 18 during movement thereof to determine if an obstruction is present in the path of travel. For example, the force sensor 31 may be integral with the movable barrier operator 12 and configured to detect a motor load of the motor 20 by measuring a mechanical and/or electrical parameter or characteristic of the motor 20 such as one or more of output torque, motor shaft speed/RPM, the amount of current or power being consumed. An obstruction being contacted by the movable barrier 18 during an operation may correspondingly increase the motor load, and if a motor load detected by the force reversal sensor 31 exceeds a threshold amount, the controller 24 of the movable barrier operator 12 may be configured to stop and/or reverse movement of the movable barrier 18. In alternative forms, the force reversal sensor 31 may be a pressure actuated switch or other mechanical sensor positioned, for example, at a lower edge of the movable barrier 18. Furthermore, in some instances the force sensor 31 may not directly detect a force that is being experienced by the motor 20 or by the movable barrier 18. That is, the force sensor 31 may be alternatively implemented substantially as software, firmware or other computer-readable instructions that may be executed or otherwise performed by the controller 24 in order to indirectly determine force(s) based on one or more electrical, mechanical, and historical factors or parameters that may be measured, calculated or inferred.

Figure 3:
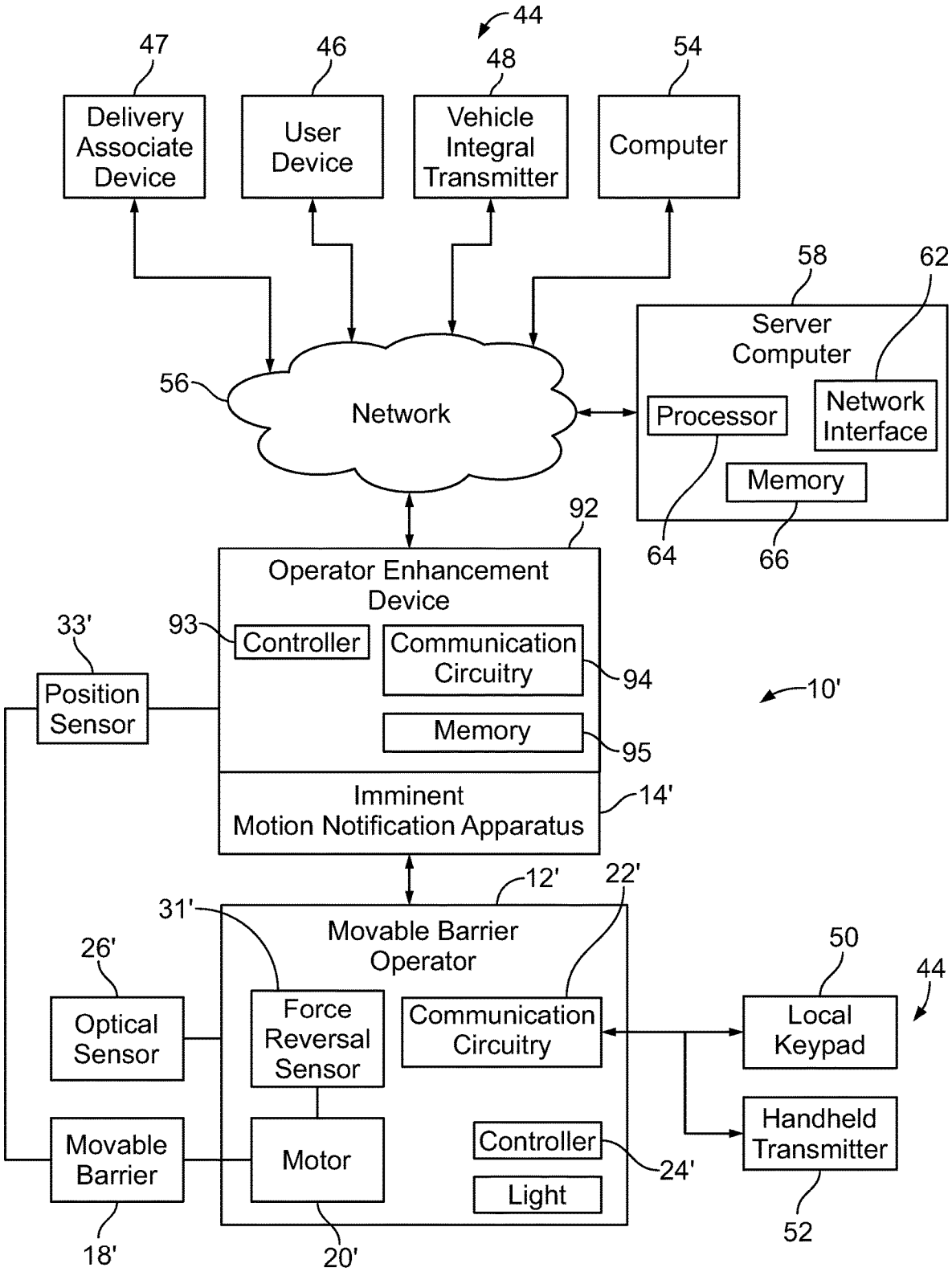
FIG. 3 is a block diagram of another movable barrier operator system showing a movable barrier operator, a moving-barrier imminent motion notification apparatus, an operator enhancement device, and a remote server computer communicatively coupled to the operator enhancement device via a network.

Referring now to FIG. 3, in some embodiments, various movable barrier operators (e.g., older, legacy, movable barrier operators) may not, by themselves, have the ability to communicate over a network 56 such as the internet. As a result, the remote server computer 58 may not be able to communicate a state change command to such a movable barrier operator 12' for changing a state of the barrier associated therewith. In such forms, a communication hub or an operator enhancement device, such as operator enhancement device 92, may be provided to facilitate receipt of communications from the remote server computer 58 by a movable barrier operator 12'. So configured, the operator enhancement device 92 may be communicatively coupled to the movable barrier operator 12' to permit the movable barrier operator 12' to be monitored and controlled over a network, such as the internet, to effect a state change of a movable barrier 18' using a smartphone application or computer internet browser for sending a state change request as described.

Specifically, another example movable barrier operator system 10' is illustrated that is similar to movable barrier operator system 10 such that any differences will be described hereinafter. Structures of the movable barrier operator system 10' that are similar to structures of the movable barrier operator system 10 are designated with similar reference numerals. The movable barrier operator system 10' is illustrated including a movable barrier operator 12' having a motor 20', communication circuitry 22', and a controller 24'. In addition, the movable barrier operator system 10' includes an operator enhancement device 92 having a controller 93, communication circuitry 94, and a memory 95. The communication circuitry 94 of the operator enhancement device 92 may permit the operator enhancement device 92 to communicate over a network, such as the internet. The communication circuitry 22' of the movable barrier operator 12' is configured to receive signals output by the operator enhancement device 92, and in some forms, the movable barrier operator 12' may be wired or wirelessly coupled to the operator enhancement device 92 to communicate various operating conditions of the movable barrier operator 12' thereto. For example, the movable barrier operator 12' may be configured to communicate signals indicating whether the motor 20' is operating, whether an overhead light is on, among other operating conditions.

The movable operator system 10' also includes an imminent motion notification apparatus 14' that is configured to output an imminent motion notification similar to the imminent motion notification apparatus 14. The imminent motion notification apparatus 14' of FIG. 3 is shown as being integrated with the operator enhancement device 92, however, the imminent motion notification apparatus 14' may alternatively be separate from the operator enhancement device 92 or integrated with the movable barrier operator 12'. The operator enhancement device 92 may be configured to facilitate operation of an imminent motion notification by the controller 93 thereof by, for example, delaying communication of a radio frequency signal to the movable barrier operator 12' after a state change command is received from the remote server computer 58, in addition to causing effecting visual and/or auditory notifications as described above via either a light and/or speaker communicatively controlled by the operator enhancement device 92.

The movable barrier operator 12' includes communication circuitry 22' to receive local communications from remote controls 44 such as a local keypad 50 and an RF transmitter 52 for changing a state of a movable barrier 18'. However, the communication circuitry 22' is not configured for communicating with the remote server computer 58 and receiving a state change command therefrom via a network such as the internet. Instead, the remote server computer 58 may communicate a state change command to the operator enhancement device 92, and the operator enhancement device 92 may communicate a radio frequency signal to operate the movable barrier operator 12' upon the operator enhancement device 92 receiving the state change command.

For example, upon the operator enhancement device 92 receiving a state change command from the remote server computer 58, the operator enhancement device 92 may send a signal, (e.g., a 300 MHz on-off keying signal) to the movable barrier operator 12' that is configured to cause the motor 20' of the movable barrier operator 12' to change a state of the movable barrier 18'. So configured, the operator enhancement device 92 permits the movable barrier operator 12' that is otherwise not able to communicate via a network to indirectly receive remote state change commands from the remote server computer 58.

The memory 95 of the operator enhancement device 92 may be configured to store data or information concerning the operation(s) of the movable barrier operator 12', and additionally may be configured to store an indication that a sensor check has been completed as described in further detail herein. For example, the operator enhancement device 92 may store a list of known transmitters or remote controls 44 in the memory 95 or may store other information such as information from sensors associated with the movable barrier operator system 10' as needed. Such information may likewise be communicated through the network 56 to the remote server computer 58.

In the illustrated form, a position sensor 33' is communicatively coupled to the operator enhancement device 14' and is configured to detect whether the movable barrier 18' is in an open position or a closed position. For example, the position sensor 33' may be a tilt switch, gyroscope, or accelerometer coupled to or associated with the movable barrier 18' to detect a position thereof. Alternatively, the position sensor 33' may be a camera configured to detect images of the movable barrier 18' and/or opening 19 for determining if the movable barrier 18' is open or closed. So configured, the operator enhancement device 14' may be configured to determine, based on the output from the position sensor 33', whether the movable barrier operator 12' has opened or closed the barrier according to a radio frequency signal output from the operator enhancement device 14' upon receipt of a state change command from the remote server computer 58.

In some embodiments, an optical sensor 26' and a force reversal sensor 31' may additionally or alternatively be communicatively coupled to the operator enhancement device 92 such that an indication that a sensor check has been completed may be stored in the memory 95 and/or the information received from the sensors 26', 31', such as signals indicating a detected obstruction, may nonetheless be wirelessly communicated to the remote server computer 58 for use in connection with the sensor check methods described hereinafter.

Figure 4:
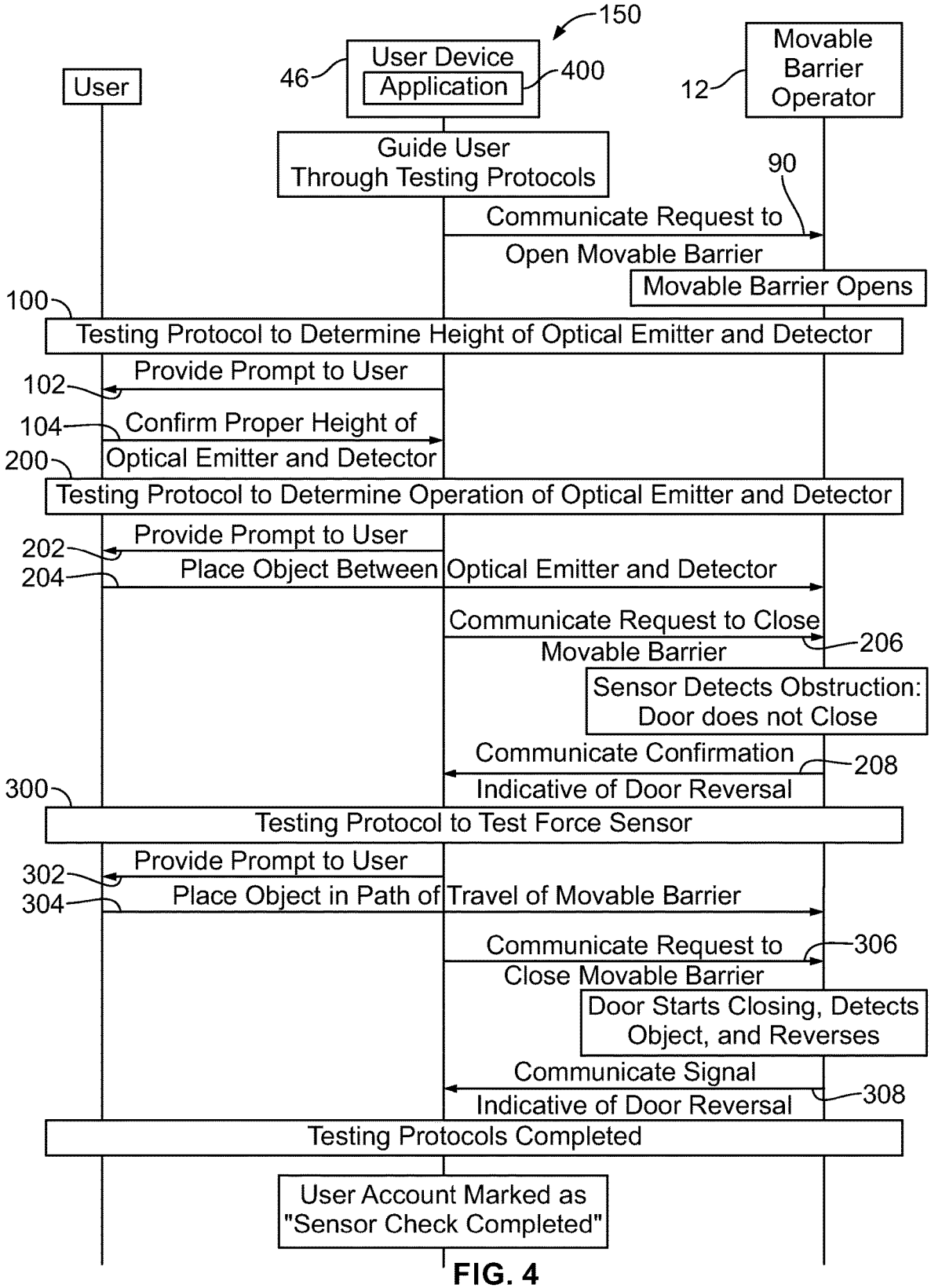
FIG. 4 is a diagram showing an example method for testing operation of sensors associated with the movable barrier operator system.

Referring now to FIG. 4, an example method 150 is provided that may be utilized with the movable barrier operator system 10 to permit a user to inhibit or "opt-out" of the imminent motion notification in connection with movement of the movable barrier 18. The method 150 includes performing one or more sensor checks to ensure proper operation of the sensors 26, 31 associated with the movable barrier operator system 10. Such sensor checks may include various testing protocols including instructions or prompts regarding performance of certain steps that are configured to test various aspects of the sensors 26, 31. For example, the sensor checks of the illustrated method 150 include a testing protocol 100 to determine whether the optical emitter 28 and the optical detector 30 are placed at a proper height, a testing protocol 200 to determine whether the optical emitter 28 and the optical detector 30 are operating properly, and a testing protocol 300 to test the force sensor 31 to determine if it is operating properly. Any individual testing protocol may be combined with other testing protocols, and additional testing protocols may be included for testing further aspects of sensor operation. For example, when the movable barrier operator 12 is a jackshaft-type operator rather than a trolley-type operator, an additional testing protocol may be included in the present method to check the operation and/or configuration of a cable tension-monitoring apparatus. Such a testing protocol for the cable tension-monitoring apparatus may entail prompting or instructing the user to watch at least one cable and look for slack therein that may not be detected by the cable tension-monitoring apparatus if faulty or not configured as per recommendations. Moreover, one or more of the testing protocols may be automated or semi-automated thereby entailing minimal or substantially no user intervention.

Figure 6:
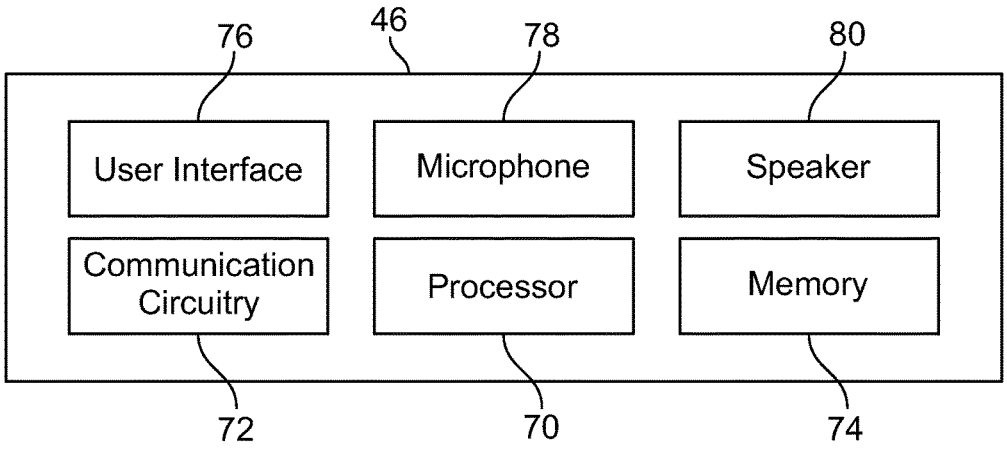
FIG. 6 is block diagram of a portable electronic device of a user.

In one aspect, the steps of the testing protocols 100, 200, 300 may be administered or otherwise facilitated via a mobile application 400 (see FIGS. 7-13) on the user's portable electronic device 46 by providing one or more of prompts and instructions to guide the user through each testing protocol. With reference to FIG. 6, the portable electronic device 46 includes a processor 70, communication circuitry 72, a memory 74, and a user interface 76. The device 46 further includes a microphone 78 and a speaker 80. In one aspect, the prompts and/or instructions may be provided to the user via displaying the instructions on the user interface 76 of the portable electronic device 46. In other forms, the application 400 may be configured to provide auditory instructions to the user through the speaker 80. The mobile application 400 installed on the user device 46 may be a mobile application associated with the manufacturer of the movable barrier operator 12, and the application 400 may be downloaded and stored in the memory 74 of the device 46. In some forms, the application 400 may receive inputs or confirmations from the user via the user interface 76 based at least in part on pressing certain physical or virtual buttons of the device 46. In other forms, the application 400 may receive auditory inputs or confirmations from the user via the microphone 78.

Referring again to FIG. 4, to begin the sensor check including the testing protocols 100, 200, and 300, the user may be prompted by the application 400 at the user interface 76 to communicate to move the movable barrier 18 to an initial, open position. The user interface 76 may provide an option to communicate the state change request via the application 400, or alternatively, the user may move the movable barrier 18 to the open position via the local transmitter 52, the wall-mounted keypad 50, or another remote control, and subsequently confirm in the application 400 that the movable barrier 18 is open before proceeding through each of the testing protocols. If the movable barrier 18 is already in the open position, the user may simply confirm the same in the application 400.

The testing protocol 100 of the sensor check is configured to determine whether the optical sensor 26, such as the optical emitter 28 and optical detector 30, is properly installed such as being positioned at a proper height with respect to a floor of the garage 16 in which the movable barrier 18 is installed. In one form, the optical emitter 28 and optical detector 30 are recommended to be placed at about six inches above the floor proximate the path of travel of the movable barrier 18, and the testing protocol 100 is configured to confirm that the optical emitter and detector 28, 30 are placed at the recommended height. To do so, the application 400 may provide an instruction to the user via the user interface 76 of the user device 46 to confirm that the optical emitter and detector 28, 30 are positioned at the proper height (communication 102). The user interface 76 may present an option such as a "confirm" button for the user to press after manually measuring the height at which the emitter and detector 28, 30 are positioned.

Additionally or alternatively, the application 400 may entail the user employing the user device 46 and/or the application 400 to take one or more pictures of the emitter and detector 28, 30 as installed in the garage 16 to be used for determining if the emitter and detector 28, 30 are positioned at the proper height. Moreover, the testing protocol 100 may entail an electronic measurement (e.g., facilitated by another application or functional module such as the iOS "Measure" application) of the optical emitter and detector 28, 30 to verify their installation at the recommended height. Alternatively, a camera 35 (see FIG. 2) communicatively coupled to the movable barrier operator 12 may automatically detect images of the optical emitter and detector 28, 30 for use in determining if they are installed at the recommended height. Once optionally confirmed (communication 104), the application 400 facilitates communication of a confirmation to the remote server computer 58 indicating compliance with the testing protocol 100. For example, the application 400 may facilitate communication of the confirmation via the communication circuitry 72 of the user device 76. Alternatively, the application 400 may facilitate communication of the confirmation via the communication circuitry 22 of the movable barrier operator 12. In some forms, the application 400 may facilitate communication of a confirmation to the remote server computer 58 after the testing protocols 100, 200, 300 of the sensor check method have been completed. In some instances, the application 400 may, if one or more of the testing protocols 100, 200, 300 has failed, indicate a corrective/remedial action for the user to take in order to successfully complete the sensor check method 150. For example, the application 400 may instruct or prompt the raising or lowering of the optical emitter 28 and detector 30 when the measured height value is not as per recommendations. After the user indicates to the application 400 that a corrective action was taken, the application may again perform the related testing protocol (e.g., height determination protocol 100) to verify that the failure was remedied.

The testing protocol 200 of the sensor check is configured to determine whether the optical emitter and detector 28, 30 are functioning properly. That is, the testing protocol 200 is configured to determine if the optical emitter 28 is properly emitting a light beam and the optical detector 30 is properly detecting that light beam during ordinary operation. As an initial step, the application 400 may provide an instruction or prompt to the user via the user interface 76 of the user device 46 to place an object six inches or taller between the optical emitter and detector 28, 30 and within a path of travel of the movable barrier 18 (communication 202). Once finished, the user may manually confirm in the app that the object has been placed in the desired position as prompted. Additionally or alternatively, the camera 35 (see FIG. 2) may detect one or more images and/or video footage of the opening 19 of the movable barrier 18, and the detected images or footage may be communicated to the remote server computer 58 to determine whether the object has been placed in the correct position by the user. So configured, placement of the object may be automatically confirmed by the remote server computer 58 to ensure the object is placed in the desired position without requiring user input. The user interface 76 may be configured to notify the user of the confirmation, and in some forms, the app may not be permitted to advance to a subsequent test until such confirmation has been determined.

Once the object is confirmed to be placed in the desired position (either manually by the user confirming in the app, or as detected by a camera 35 associated with the movable barrier operator system 10) (communication 204), a state change request may be communicated to attempt to close the movable barrier 18 (communication 206). The state change request may be manually communicated by the user using, for example, the portable electronic device 46, or may be automatically communicated to remote server computer 58. If the emitter and detector 28, 30 are functioning properly, an obstruction will be detected and the movable barrier 18 will either reverse after beginning to close or the movable barrier operator 12 will not actuate to close the barrier 18. Similarly, upon the movable barrier operator 12 sensing the obstruction, the communication circuitry 22 of the movable barrier operator 12 may communicate a confirmation indicating that the optical emitter 28 and the optical detector 30 are functioning properly (communication 208) to the remote server computer 58 (e.g., through the application 400 on the portable electronic device 46). In an alternative implementation the user is prompted or instructed to move an object (e.g., a wood two-by-four, the user's hand/arm or foot/leg, etc.) between the emitter and detector to momentarily interrupt the optical beam during closure of the movable barrier, in response to which the movable barrier operator 12 is configured to reverse movement of the movable barrier and communicate the perceived momentary obstruction to the remote server computer 58.

Another testing protocol 300 of the sensor check is configured to determine whether the force reversal sensor 31 is functioning properly. As an initial step, the application 400 may provide an instruction or prompt to the user via the user interface 76 of the user device 46 to place an object within a path of travel of the movable barrier 18 (communication 302). In one example, the application 400 may instruct the user to place a two-by-four plank of wood or other common object on the ground in the path of travel. Once the object is confirmed to be placed in the desired position (either by the user, or as detected by the camera 35 associated with the movable barrier operator system 10 as described in further detail above) (communication 304), a state change request may be communicated to attempt to close the movable barrier 18 (communication 306). The state change request may be manually communicated by the user using, for example, the portable electronic device 46, or may be automatically communicated via the application 400. The movable barrier 18 will begin to move from the open position to the closed position until contacting the object. As the movable barrier 18 contacts the object, the motor load of the motor 20 will increase and be detected by the force reversal sensor 31. If the force reversal sensor 31 is functioning properly, upon the motor load exceeding a predetermined threshold, the controller 24 of the movable barrier operator 12 will cause the motor 20 to reverse the movable barrier 18 and return the movable barrier 18 to the open position. The communication circuitry 22 of the movable barrier operator 12 may then communicate a confirmation indicating that the force reversal sensor 31 is functioning properly (communication 308) to the remote server computer 58 (e.g., through the application 400 on the portable electronic device 46).

Various other sensors may also be included with the movable barrier operator system 10 and such sensors may be tested in a similar manner using testing protocols administered at least in part by instructions and/or prompts provided by the application 400. For instance, in an embodiment where the optical sensor 26 includes a camera, the application 400 may provide an instruction to guide a user through a process of testing to ensure the camera is functioning as intended such as the garage door opening 19 being within the field of view of the camera. Additionally or alternatively, the sensors 27 such as the force reversal sensor 31 and the optical sensor 26 may be tested to detect other operating conditions thereof, such as detecting if sufficient power is being supplied to the sensors.

Although the testing protocols shown in FIG. 4 are illustrated as occurring sequentially, each testing protocol 100, 200, and 300 and its corresponding steps/instructions may be performed in any order so long as the sensors are properly tested to ensure that the sensors are functioning as intended for operation of the movable barrier 18.

The portable electronic device 46 and the movable barrier operator 12, either alone or in combination with one another, may be configured to communicate the confirmation to the remote server computer 58 indicating proper functionality of the sensors 26, 31 associated with the movable barrier operator system 10 either during or after the sensor check has been completed. For example, in one form, the movable barrier operator 12 may communicate a confirmation to the remote server computer 58, and upon receipt of the confirmation, the remote server computer 58 may be configured to communicate an attended state change command to the movable barrier operator 12 when a subsequent state change request is received. In another form, the movable barrier operator 12 may communicate the confirmation to the user's portable electronic device 46, and the device 46 may communicate that confirmation to the remote server computer 58 via the communication circuitry 72. Upon receiving the confirmation indicative of the sensor check being completed, the remote server computer 58 may be configured to communicate an attended state change command to the movable barrier operator 12 when a subsequent state change request is received, and the attended state change command is configured to inhibit operation of the imminent motion notification apparatus 14 in connection with a change of state of the movable barrier 18. In other forms, the portable electronic device 46 and/or the movable barrier operator 12 may store an indication in a respective memory thereof that the sensor check has been performed as an alternative or in addition to communication of the confirmation to the remote server computer 58.

In some embodiments, such as the movable barrier operator system 10' shown in FIG. 3 where the movable barrier operator 12' is unable to communicate directly with the remote server computer 58 via the internet, the confirmation indicating proper functionality of the sensors being tested may alternatively be communicated to the remote server computer 58 via either the user device 46 or the operator enhancement device 92. In addition, the attended or unattended state change commands as described herein may alternatively be sent via the network interface 62 of the remote server computer 58 to the operator enhancement device 92 for controlling operation of the movable barrier operator 12' of FIG. 3 in a similar manner based upon determinations of the processor 64 of the remote server computer 58.

In some forms, the remote server computer 58, the remote control 44, the movable barrier operator 12, or another computing device may be configured to store data or other information indicating that the user has performed a sensor check by completing the testing protocols for a specific movable barrier operator system in a memory, such as the memory 66 of the remote server computer 58. For example, the remote server computer 58 may store an indication such as a "flag" associated with a user account in the memory 66, and presence of the flag for the user account is used to determine whether or not a sensor check has been performed for a specific movable barrier operator system. Additionally or alternatively, the flag associated with the user account may be set in the memory 66 of the remote server computer 58 and the application 400 installed on the user device 46, or the flag may also be set in a memory of the movable barrier operator 12. In an embodiment where the flag is set in the memory 66 of the remote server computer 58, upon receiving a state change request from a remote control 44, the processor 64 of the remote server computer 58 may be configured to determine whether a flag has been set for a user account associated with the movable barrier operator system to be operated via the state change request, and if so, causes communication of an attended state change command. Otherwise, if determined that a flag has not been set, the remote server computer 58 communicates an unattended state change command.

In some embodiments, the indication that the sensor check has been performed for a specific movable barrier operator system, such as the flag, may only be stored in the memory 66 (or other memory in which the indication is stored) temporarily. The remote server computer 58 or another device in which the indication is stored may further be configured to automatically remove the indication that a sensor check has been performed from a specific user's account based on a number of different predetermined conditions. Alternatively, the indication may be removed manually by the user or an administrator having access to the user account. Once the indication has been removed, the user is required to re-perform the sensor check to compensate for changes that may occur to the sensors over time. So configured, the user may be prompted to re-perform the sensor checks on a periodic basis.

In one embodiment, the processor 64 of the remote server computer 58 may be configured to automatically remove the indication that the sensor check has been performed after a predetermined period of time, and the user must then re-perform the sensor check if the user desires to inhibit use of the imminent motion notification apparatus 14 in connection with a change of state of the movable barrier 18. In one example, an indication associated with a user account may be stored in the memory 66 including an associated time stamp or date stamp identifying when the indication was set (e.g., see FIG. 5). So configured, the processor 64 may be configured to determine whether a predetermined amount of time has passed indicating that the indication is "stale," and whether the sensor check should be re-performed. In such an embodiment, the stored indication may be removed from the user's account after a period of about three to six months after the indication is set to account for potential changes in operation of the sensors 26, 31 of the movable barrier operator system 10 that may have occurred over that duration.

In another example, the processor 64 of the remote server computer 58 may be configured to automatically remove the data indicating that the sensor check has been performed based at least in part on weather conditions associated with the location where a specific movable barrier operator system 10 is located. For example, in areas where there may be an especially harsh winter or other frequently extreme weather conditions, it may be beneficial to request of the user to re-perform the sensor check including the testing protocols 100, 200 and 300 when specific weather conditions have been detected to ensure proper continued operation of each of the sensors 26, 31. Such weather condition information may be detected using one or more sensors (e.g., a temperature sensor) communicatively coupled to the movable barrier operator system 10 or may alternatively be retrieved from a weather reporting service by the server computer 58.

In yet another example, the processor 64 of the remote server computer 58 may be configured to automatically remove the indication that the sensor check has been performed based at least in part on a number of obstructions detected by the sensors 26, 31 associated with the movable barrier operator system 10 exceeding a threshold number. In one form, the movable barrier operator 12 may be configured to communicate information to the remote server computer 58 indicating that an obstruction has been detected by one or more sensors 26, 31. In one example, if more than five obstructions are detected by either the optical sensor 26 or the force reversal sensor 31 in a specified time period (e.g., a day), it may be assumed that obstructions may frequently occur for the respective movable barrier operator system 10 and it would be encouraged to perform sensor checks more often so that operation of the sensors 26, 31 is more frequently assessed.

Although the remote server computer 58 may be automatically configured to communicate attended state change commands to the movable barrier operator 12 once the sensor check has been completed, the processor 58 may additionally be configured determine whether the user has manually enabled an "attended mode" via the application 400 on the portable electronic device 46. For example, once the sensor check including the testing protocols has been completed, and the sensors 26, 31 are determined to be functioning as intended, the user may be presented with an option in the user interface 76 to enable an "attended mode" to inhibit a portion of, or all of, the imminent motion notification provided by the imminent motion notification apparatus 14 when a state change command is received by the movable barrier operator 12 (see, e.g., FIG. 12). Upon toggling or selecting in the application 400 that the user would like to enter the attended mode, the user device 46 may communicate a signal representative of the selection to middleware associated with the application 400 and/or the remote server computer 58 and the selection may be stored in a memory (e.g., memory 66) indicating that the user has opted to enable the attended mode feature. In an embodiment including the attended mode feature, upon receiving a state change request, the processor 64 of the remote server computer 58 first determines whether the user account associated with the state change request has enabled the attended mode. If the attended mode is enabled, the processor 64 causes the network interface 62 to communicate an attended state change command to the movable barrier operator 12. Otherwise, the processor 64 causes the network interface 62 to communicate an unattended state change command to the movable barrier operator 12.

Figure 5:
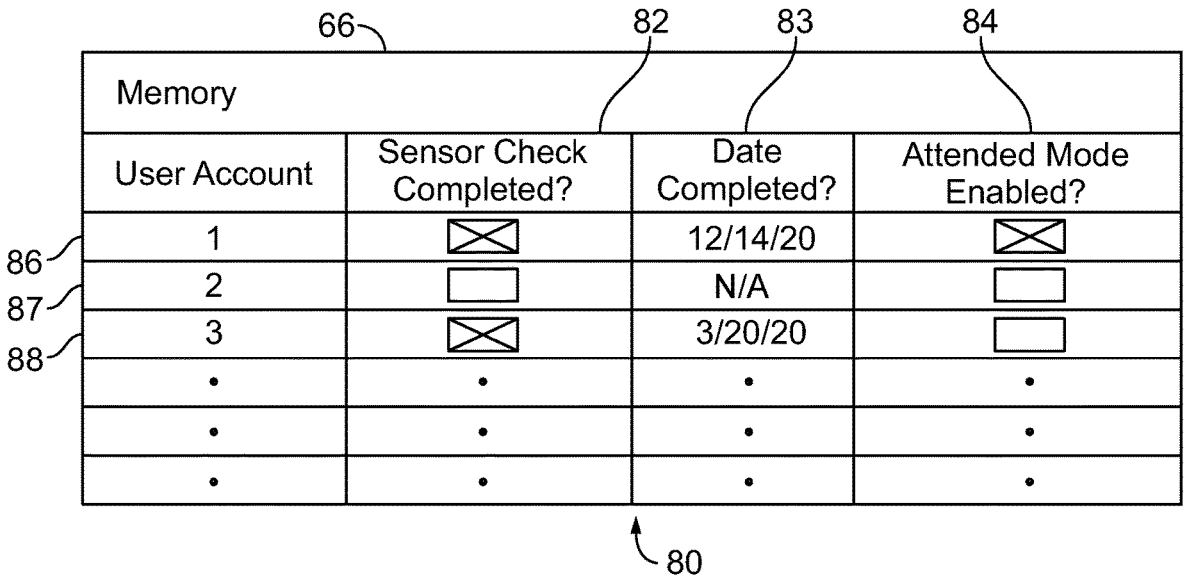
FIG. 5 shows an example data structure for storing information associated with a plurality of user accounts.
Figure 7:
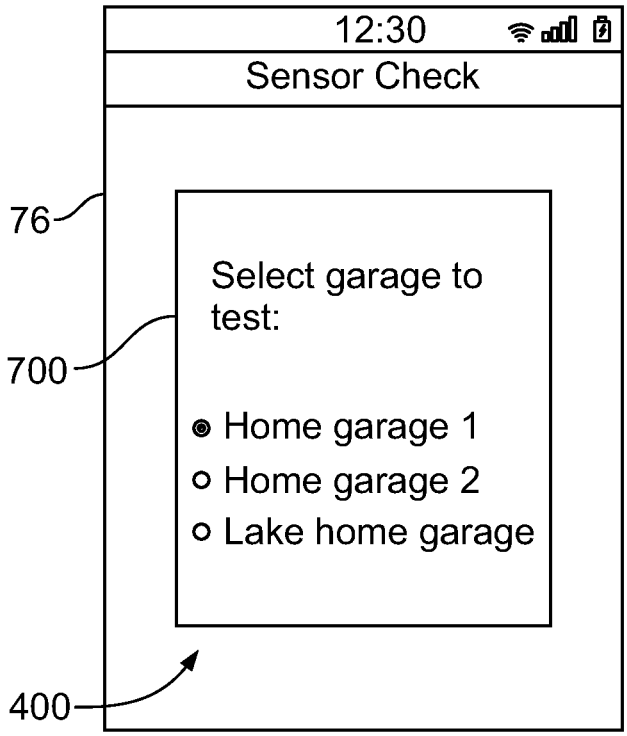
FIGS. 7-13 illustrate example screenshots of an application installed on a portable electronic device of a user of the movable barrier operator system of FIG. 1.

Referring now to FIG. 5, an example data structure 80 is shown indicating whether a sensor check has been completed for a plurality of user accounts and whether a user, for their user account, has manually enabled the attended mode feature. In the illustrated form, the data structure 80 is stored in the memory 66 of the remote server computer 58, but in alternative forms, a similar data structure unique for each user account may additionally or alternatively be stored locally in the memory 74 of the user's portable electronic device 46, a memory of a respective movable barrier operator 12, or a memory of an operator enhancement device 92. Although not illustrated, in some forms a user account may be associated with one or more movable barrier operators (e.g., a home movable barrier operator, a lake house movable barrier operator, etc., as shown in FIG. 7) such that the memory 66 may additionally store information indicating whether the user has performed a sensor check or enabled the attended mode for each of the one or more movable barrier operators. In still other forms, the data structure 80 may only store information relating to whether the user has manually enabled the attended mode or may only store information regarding whether the sensor check has been completed (e.g., a flag associated with the user's account).

In one aspect, the remote server computer 58 or other device may only be permitted to communicate an attended state change command to a specific movable barrier operator system if both a sensor check has been completed for the sensors of that movable barrier operator system and if the user has enabled the attended mode. With reference to the data structure of FIG. 5, the processor 64 of the remote server computer 58 is configured to reference the data structure 80 to determine if the sensor check has been completed based on the presence of a flag in column 82 and/or the user has enabled the attended mode based on the presence of a flag in column 84. For simplicity in illustration, the "flags" are illustrated as checked boxes however another indicium may be employed such as an integer value, binary or Boolean indications, etc. Furthermore, the data structure 80 may store or otherwise include a human-readable or machine-readable enumeration regarding performance of the safety check, the enumeration being verbose (constituted by a plurality of values) or non-verbose that define aspects of the safety check (e.g., time, date, ambient temperature, force value(s), etc.). For example, for user account 1 (row 86), the processor 64 would determine that both the sensor check has been completed and the user has enabled the attended mode and would correspondingly cause communication of an attended state change command upon receiving a state change request. In contrast, for user account 2 (row 87) the sensor check has not been completed and the processor 64 would be configured to communicate an unattended state change command. Similarly, for user account 3 (row 88), the user has not enabled the attended mode and the processor would be configured to communicate an unattended state change command. In other forms, the processor 64 may be configured to communicate the attended state change command irrespective of whether the user has enabled an attended mode so long as the sensor check has been completed.

In alternative forms where the indication and/or enabling of the attended mode has been stored in a memory of the remote control 44 or the movable barrier operator 12, the foregoing determinations may be performed by a respective processor of the remote control 44 or of the movable barrier operator 12 to determine whether to inhibit or cause operation of an imminent motion notification.

As discussed in further detail above, the data indicating that the sensor check has been completed (e.g., the flag stored in column 82 of the data structure 80 associated with the user's account) may be removed by the processor 64 of the remote server computer 58 or another device after a predetermined period of time. For example, the data structure 80 may include a column 83 including a date stamp identifying when the flag in column 82 was initially set, and the processor 64 may be configured to detect whether a predetermined amount of time has passed since the flag was set, thus indicating whether the set flag is stale and whether sensor check should be re-performed. In a similar manner, the processor 64 may be configured to automatically disable the attended mode for a user account based on one or more of the conditions described above. If the user desires to re-enable the attended mode, the user is required to re-perform the sensor check including the various testing protocols 100, 200, 300 to test the sensors 26, 31 before being permitted to re-select the attended mode in the application 400.

The determination by the remote server computer 58 of whether to communicate an attended or unattended command message may also be based at least in part on whether the remote control 44 communicating the state change request is determined to be located within a predetermined proximity of a location associated with the movable barrier operator system 10. For example, even though the sensor check has been completed and/or the user has enabled the attended mode feature, the remote server computer 58 may nonetheless be configured to communicate an unattended state change command to cause operation of the imminent motion notification apparatus 14 if the remote control 44 that the state change request is received from is not within a predetermined proximity of the movable barrier operator system 10. Such a predetermined proximity could be set by the entity operating the remote server computer 58 and may be set as a threshold distance, such as a radius of about fifty meters. If a determination indicates that the remote control 44 is within the predetermined proximity, the remote server computer 58 sends the attended state change command to the movable barrier operator 12. In some forms, the proximity determination may be performed by the processor 64 of the remote server computer 58, by a processor of the remote control 44 (e.g., processor 70 of the portable electronic device 46), and/or by the controller 24 of the movable barrier operator 12 and communicated to the remote server computer 58 for use in a determination of whether an attended or unattended state change command should be sent.

The proximity determination may be based on one or more of the following methods for obtaining proximity-related information of the remote control 44 communicating the state change request including, but not limited to, dead reckoning determinations, angle of arrival measurements, time of flight determinations, received signal strength indication (RSSI) thresholding, comparison of global navigation satellite system (GNSS) data such as global positioning satellite (GPS) data, analysis of data obtained via remote sensors (e.g., a camera configured to detect image data including physical characteristics of a user), LiDAR scanning, or a combination thereof. In addition, the proximity determination may be based on a determination of whether the remote control 44 sending the state change request is within a geofenced area associated with the movable barrier operator system 10, such as a geofence surrounding a driveway associated with a garage. Determining whether the remote control 44 is within a predetermined proximity to the movable barrier operator system 10 before communicating an attended state change command may be desirable in some applications.

In some forms, a determination of whether the remote control 44 is within the predetermined proximity to the movable barrier operator system 10 may be based on time-related factors and the remote server computer 58 may implement a time-based restriction as opposed to calculating a raw distance from the movable barrier operator system 10 or comparing GPS coordinates to a geofenced area such as described above. In other forms, the proximity determination already described may be used in connection with the time-based restrictions as now described to achieve a greater confidence that the user communicating the state change request is proximate the movable barrier. For example, the remote server computer 58 may be configured to determine if the remote control 44 is within a predetermined proximity based on a time interval measured since a prior state change request was received. For instance, a user may arrive home and communicate a state change request to open movable barrier 18 to park a vehicle in garage 16. Shortly thereafter, the user may communicate a subsequent state change request to close the movable barrier 18 (e.g., after the vehicle has been parked within the garage 16). Upon a determination by the processor 64 that the subsequent state change request was received before a threshold time limit is exceeded (e.g., about thirty seconds to about one minute), the remote server computer 58 may be permitted to communicate an attended state change command and inhibit operation of the imminent motion notification apparatus 14 based upon a likelihood that the user is still proximate the movable barrier 18.

In a similar manner, the remote server computer 58 may be permitted to communicate an attended state change command based on a measured amount of time a vehicle proximate the garage 16 has been turned on. In embodiments where the user's vehicle 17 (FIG. 1) includes a vehicle infotainment system 48 that is configured to communicate with the remote server computer 58, the remote server computer 58 may be configured to detect how long the vehicle 17 has been turned on based on vehicle sensor(s). For example, if the vehicle 17 was last detected as being parked within the garage 16, and the vehicle 17 has only been turned on for a short period of time (e.g., up to about thirty seconds), there is a likelihood that the user and the vehicle 17 are still proximate the movable barrier 18 (i.e., either in the garage 16 ready to communicate a state change request to open the movable barrier, or outside the garage 16 ready to communicate a state change request to close the movable barrier). If the processor 64 of the remote server computer 58 determines that the vehicle 17 has not been on for longer than a specific time threshold (e.g., about thirty seconds), the processor 58 may be configured to cause communication of the attended state change command upon receiving a state change request.

The testing protocols 100, 200, 300 and sensor check provided herein may be useful for effecting delivery of certain items to the user via a delivery associate, such as an Amazon or UPS delivery person, who may be granted temporary access to a user's garage for securely delivering a package therein. In an example where the movable barrier 18 is a garage door and the movable barrier operator 12 is a garage door opener, the delivery associate may request access to the user's garage 16 to deliver a package therein using a portable electronic delivery device 47 (FIGS. 1 and 2; e.g., a mobile phone or tablet) from the remote server computer 58. For example, the delivery associate's access request may be first communicated to a server computer associated with a specific delivery platform, and the server computer associated with that delivery platform may communicate (e.g., via an application programming interface (API)) an access request to the remote server computer 58. Upon receiving the request, the remote server computer 58 may communicate a state change command configured to change a state of the garage door to permit temporary access to the garage. In prior systems, when a delivery associate used the associate's smartphone to request closing of a garage door, the delivery associate would be required wait for an imminent motion notification to finish before closing of the garage door which may result in delay of the delivery and frustration on behalf of the delivery associate. However, if the sensor check has been completed by the user and/or the user has enabled the attended mode in accordance with the system 10 discussed previously, the remote server computer 58 may be configured to communicate an attended state change command in response to receiving a state change request from the delivery associate that will inhibit, prevent, or bypass operation of the imminent motion notification apparatus 14 and reduce time delay associated with the delivery.

Figure 8:
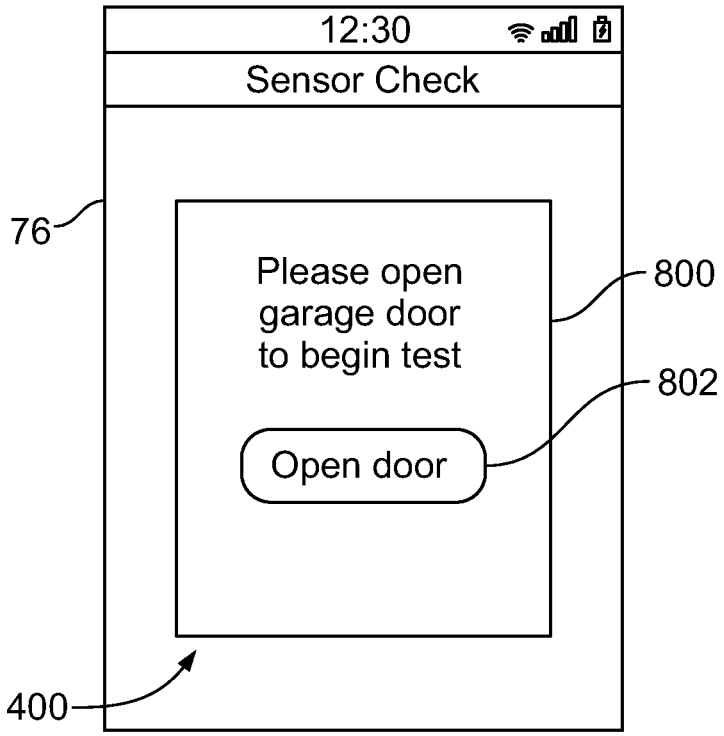

Referring now to FIGS. 7-13, various example screenshots of the graphical user interface of the mobile application 400 installed on the user's portable electronic device 46 are shown illustrating example instructions, prompts and steps to be performed to complete testing protocols for testing operation of the sensors. For example, as shown in FIG. 7, upon selecting an option to perform a sensor check in the application 400, the user interface 76 provides a list 700 of some or all garages associated with the user's account and the user may select for which specific garage they would like to perform the sensor check. Upon selection of the desired garage, the user interface 76 may begin guiding the user through the testing protocols 100, 200, 300 on a screen-by-screen basis. In FIG. 8, the user interface 76 provides an instruction 800 for the user via the application 400 to begin the sensor check by opening the garage door of the chosen garage by pressing an "open door" button 802 presented to the user. Once confirmed that the garage door has been opened (e.g., by either the user device 48, wall-mounted keypad 50 or other remote control 44), the application 400 begins guiding the user through the different testing protocols 100, 200, 300 each designed to assess whether sensors 26, 31 associated with the garage are configured and operating properly.

Figure 9:
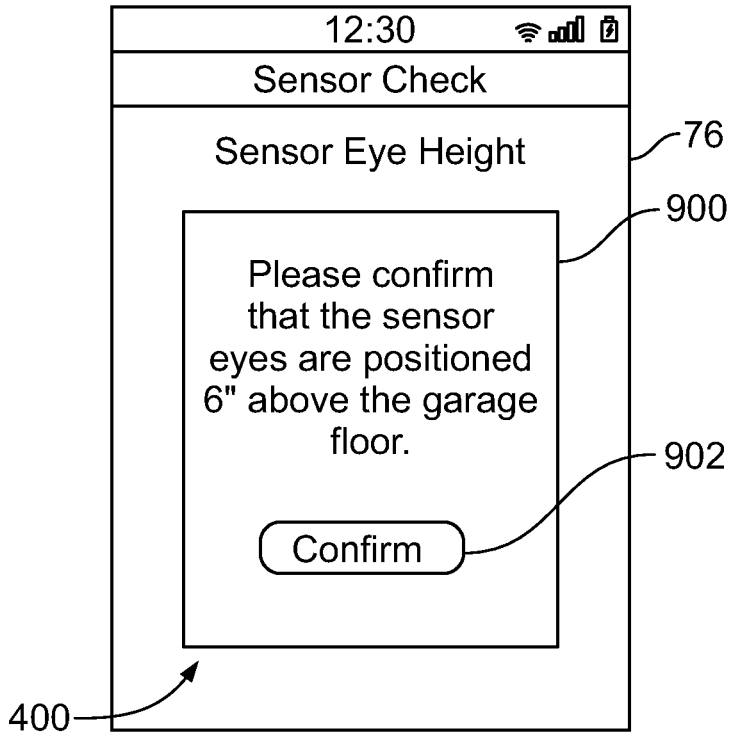

In FIG. 9, the user interface 76 provides a prompt or instruction 900 for testing protocol 100 for the user to confirm that the "sensor eyes" (e.g., an optical emitter and an optical detector) are positioned at or about a specific height (e.g., a maximum of about six inches) above the garage floor and presents a button 902 for the user to "confirm" that the sensor eyes are positioned as recommended. As previously mentioned, the confirm button 902 may effect an automatic height measurement of the sensor eyes by, for example, instantiation of a camera/vision-related module or application such as the native iOS "Measure" app.

Figure 10:
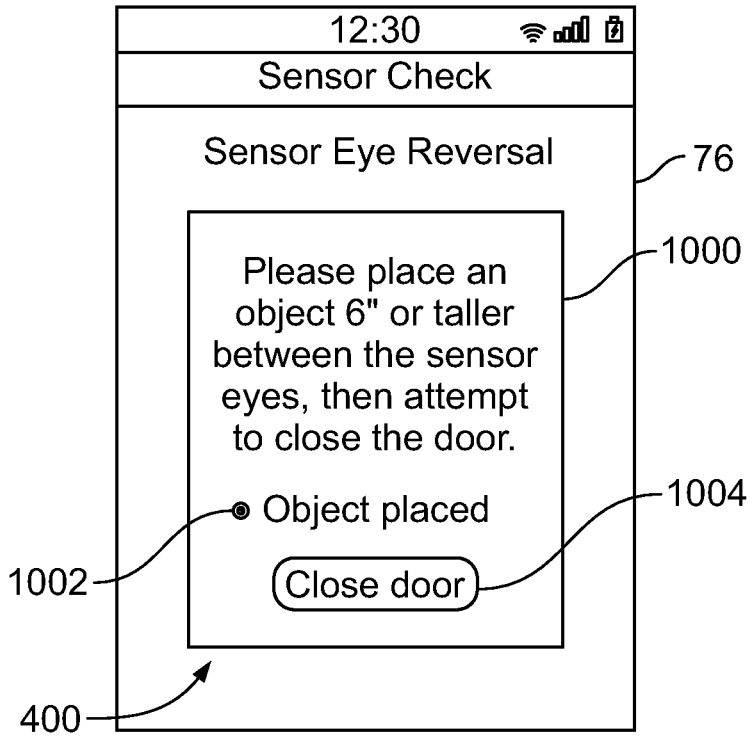

In FIG. 10, the user interface 76 provides a prompt or an instruction 1000 for testing protocol 200 for testing the operation of the sensor eyes. Specifically, the instruction 1000 prompts the user to place an object six inches or taller between the sensor eyes such that the object is able to interrupt a light beam between the optical emitter 28 and the optical detector 30. The user interface 76 may be operable to receive a toggled input 1002 from the user indicating that the object has been placed as requested and may also include a "close door" button 1004 for the user to press once the object has been placed. In some forms, the close door button 1004 may not be accessible or actuable (e.g., greyed out) until the user has confirmed via input 1002 that the object has been placed according to the instruction 1000. Alternatively, as described above, a camera associated with the movable barrier operator system may be configured to detect whether the object has been properly placed between the emitter and detector 28, 30 without requiring manual input from the user. If the sensor eyes are operating correctly, the garage door will either stop moving and reverse or not even begin moving upon a state change command being received at the movable barrier operator.

Figure 11:
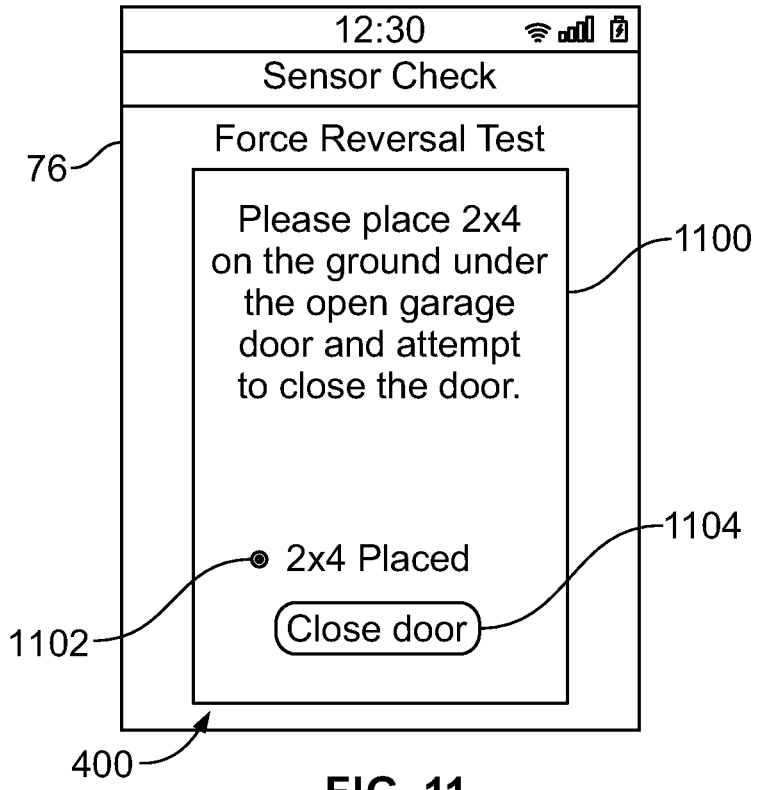

In FIG. 11, the user interface 76 provides a prompt or instruction 1100 for testing protocol 300 for testing the operation of the force reversal sensor 31 and prompts the user to place a two-by-four plank of wood on the ground in a path of travel of the garage door. The user interface 76 is operable to receive a toggled input 1102 from the user indicating that the object has been placed as requested and may also include a "close door" button 1104 for the user to press once the object has been placed. In some forms, the close door button 1104 may not be accessible or actuable (e.g., greyed out) until the user has confirmed that the object has been placed according to the instruction. In alternative forms, as described above, a camera associated with the movable barrier operator system may be configured to detect whether the two-by-four has been placed in the proper position without requiring manual input from the user. If the force reversal sensor 31 is operating correctly, the garage door will begin to close and then reverse upon contacting the object placed by the user. Upon completion of the testing protocols 100, 200, 300, either the user's portable electronic device 46 or the garage door opener associated with the garage may be configured to communicate a confirmation to the remote server computer 58.

Figure 12:
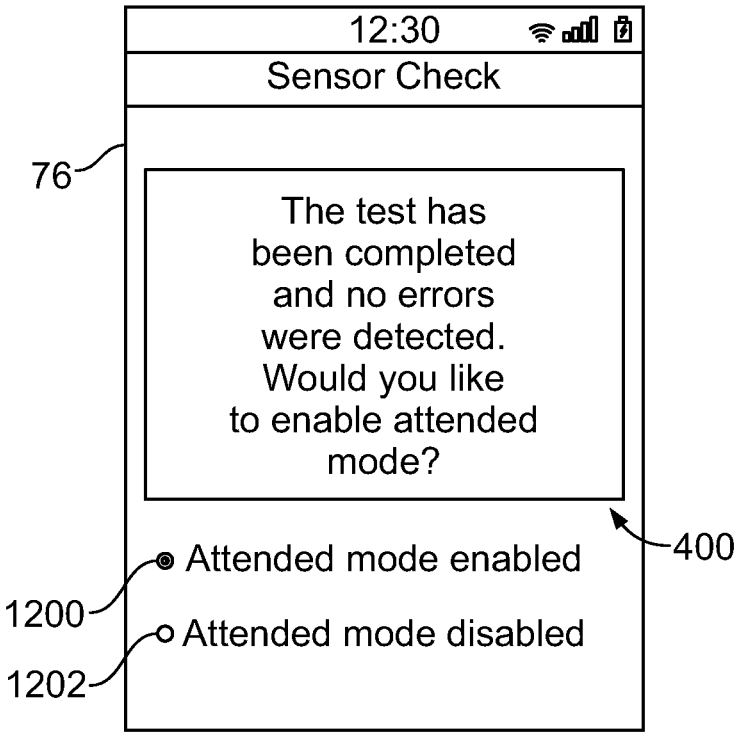

In FIG. 12, if the testing protocols 100, 200, 300 for sensors 26, 31 associated with the garage indicate that the sensors 26, 31 are configured and operating correctly, the user interface 76 presents the user with an option 1200 to enable an attended mode to inhibit operation of the imminent motion notification apparatus 14 in the manner described previously and an option 1202 to disable the attended mode. As illustrated, these options 1200, 1202 are presented to a user as a selectable toggles or radio buttons and permit a user to enable or disable the attended mode as desired. In other forms, the application 400 may automatically enable the attended mode upon completion of the sensor check including the testing protocols.

Figure 13:
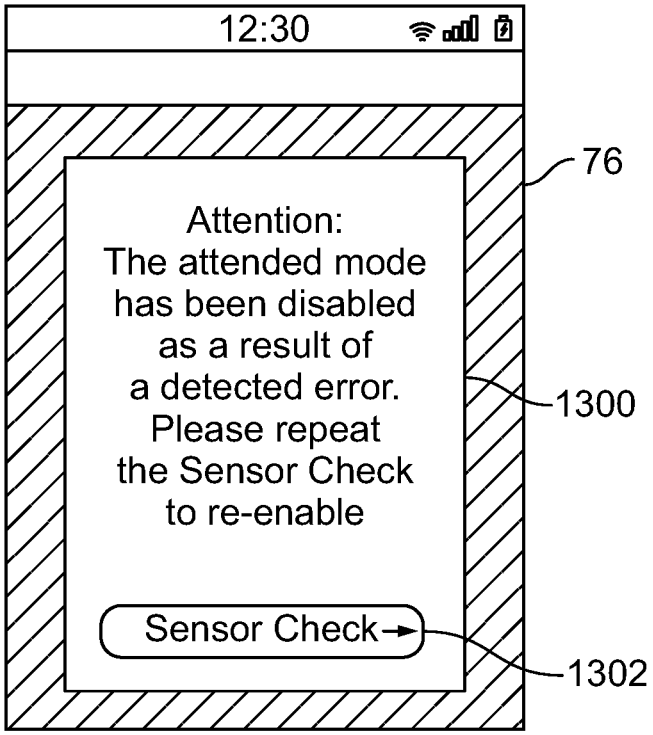

In FIG. 13, a notification 1300 is provided to the user via the user interface 76 via the application 400 indicating that the attended mode has been disabled for the user's account and that the sensor check and testing protocols 100, 200, 300 will need to be newly performed to re-enable the attended mode. As described previously in further detail, the attended mode may be either manually or automatically disabled based on a number of conditions, such as a passage of a predetermined amount of time. As shown, the user interface 76 also includes a button 1302 for directing the user for an initial screen to begin the sensor check, such as the screen shown in FIG. 7.

Figure 14:
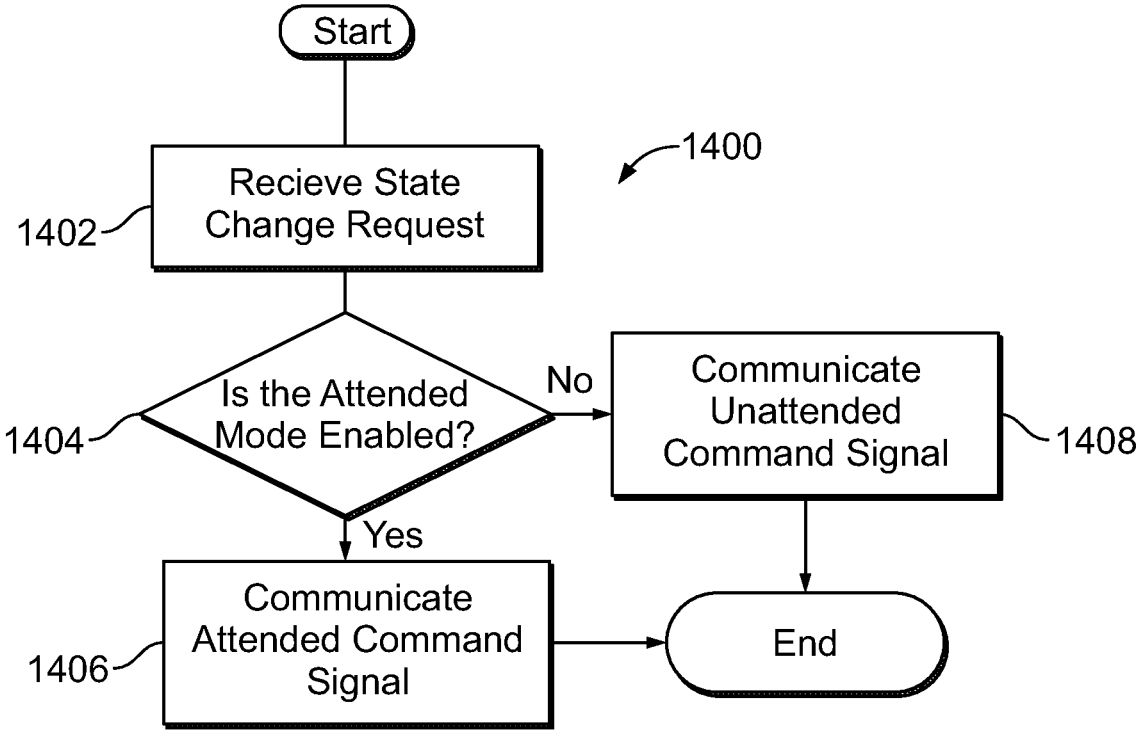
FIG. 14 is a flow chart of an example method of operating a movable barrier via a remote computing device.

Referring now to FIG. 14, an example method 1400 is shown for using the remote server computer 58 to change a state of the movable barrier 18 using either an attended state change command or an unattended state change command based at least in part on whether the user associated with the movable barrier operator system 10 has enabled the attended mode relative to the previously described sensor check. In block 1402, the network interface 62 of the remote server computer 58 receives a state change request from a remote control 44 requesting to change a state of the movable barrier 18. In one example, the state change request may be received from the user via the user device 46 to access an area secured by a movable barrier 18, and in other forms, the state change request may be received from a delivery associate desiring to access the area to deliver a package via a delivery device 47. In block 1404, the processor 64 of the remote server computer 58 is configured to determine if the user account associated with the movable barrier operator system 10 has enabled the attended mode after a sensor check has been performed. If in block 1404 the processor 64 determines that the attended mode is enabled, in block 1406, the processor 64 is configured to cause the network interface 62 to communicate an attended state change command to the movable barrier operator 12 associated with the movable barrier operator system 10 that is configured to change a state of the movable barrier 18 and inhibit, prevent, or bypass operation of the imminent motion notification apparatus 14. If in block 1404 the processor 64 determines that the attended mode is not enabled, in block 1408, the processor 64 is configured to cause the network interface 62 to communicate an unattended state change command to the movable barrier operator 12 that is configured to change a state of the movable barrier 18 in connection with operation of the imminent motion notification apparatus 14.

The terms and expressions used herein have the ordinary technical meaning as is accorded to such terms and expressions by persons skilled in the technical field as set forth above except where different specific meanings have otherwise been set forth herein. The word "or" when used herein shall be interpreted as having a disjunctive construction rather than a conjunctive construction unless otherwise specifically indicated. Further uses of singular terms such as "a," and "an," are intended to cover both the singular and the plural, unless otherwise indicated herein or clearly contradicted by context. The terms "comprising," "having," "including," and "containing" are to be construed as open-ended terms. It is intended that the phrase "at least one of" as used herein be interpreted in the disjunctive sense. For example, the phrase "at least one of A and B" is intended to encompass A, B, or both A and B.

Those skilled in the art will recognize that a wide variety of modifications, alterations, and combinations can be made with respect to the above-described embodiments without departing from the scope of the invention. For instance, although the described embodiments include a garage having a garage door, various types of movable barrier systems can employ these teachings, for example, swinging gates, rolling gates, rising gates, and the like. It is intended for the present invention to cover all the modifications, alterations, and combinations which fall within the scope of the appended claims. Such modifications, alterations, and combinations are intended to be viewed as being within the ambit of the inventive concept.

What is claimed is:

1. A portable electronic device to setup a movable barrier operator system including an imminent motion notification apparatus, the portable electronic device comprising:

a user interface;

communication circuitry configured to communicate with the movable barrier operator system;

a processor operably coupled to the user interface and the communication circuitry, the processor configured to:

cause the user interface to provide a first testing protocol for testing an optical sensor of the movable barrier operator system, the first testing protocol including a first prompt;

cause the user interface to provide a second testing protocol for testing a force reversal sensor of the movable barrier operator system, the second testing protocol including a second prompt; and facilitate communication of a confirmation indicating compliance with the first and second testing protocols to a remote server computer, the confirmation configured to permit the remote server computer to communicate an attended state change command to the movable barrier operator system and effect a state change of a movable barrier without operation of the imminent motion notification apparatus.

2. The portable electronic device of claim 1, wherein the processor is configured to cause the communication circuitry to communicate the confirmation indicating compliance with the first and second testing protocols to the remote server computer.

3. The portable electronic device of claim 1, wherein the communication circuitry is configured to receive a signal indicative of compliance with the first and second testing protocols from the movable barrier operator system, and upon receiving the signal, the communication circuitry being configured to communicate the confirmation to the remote server computer.

4. The portable electronic device of claim 1, wherein the communication circuitry is configured to receive a signal indicating that the movable barrier operator system communicated, to the remote server computer, the confirmation indicating compliance with the first and second testing protocols.

5. The portable electronic device of claim 1, wherein the user interface is operable to receive at least one of:

a first input from a user indicating compliance with the first prompt; and a second input from the user indicating compliance with the second prompt.

6. The portable electronic device of claim 1, wherein the user interface is operable to receive a user input requesting a change of state of the movable barrier;

wherein the processor is configured to cause the communication circuitry to communicate a state change request to the remote server computer via a network in response to the user interface receiving the user input requesting the change of state of the movable barrier; and wherein the state change request is configured to cause the remote server computer to communicate the attended state change command to the movable barrier operator system and effect the state change of the movable barrier without operation of the imminent motion notification apparatus.

7. The portable electronic device of claim 1, wherein the first testing protocol includes a determination of whether the optical sensor is at a predetermined height based on at least one of:

an input from a user indicating that the optical sensor is at the predetermined height; and detection, by a sensor associated with the movable barrier operator system, of the optical sensor at the predetermined height.

8. The portable electronic device of claim 1, wherein the first testing protocol includes placement of an object to interfere with a light beam of the optical sensor and a determination of whether the object has been placed to interfere with the light beam based on at least one of:

an input from a user indicating that the object is placed to interfere with the light beam; and detection, by a sensor associated with the movable barrier operator system, of the object placed to interfere with the light beam.

9. The portable electronic device of claim 1, wherein the second testing protocol includes placement of an object in a path of the movable barrier without the object interrupting a light beam of the optical sensor, and a determination of whether the object has been placed in the path of the movable barrier without the object interrupting the light beam of the optical sensor based on at least one of:

an input from a user indicating that the object is placed in the path of the movable barrier; and detection, by a sensor associated with the movable barrier operator system, of the object placed in the path of the movable barrier.

10. The portable electronic device of claim 1, wherein the processor is configured to facilitate communication of network credentials to the movable barrier operator system during setup of the movable barrier operator system.

11. The portable electronic device of claim 1, wherein upon completion of the first and second testing protocols, an attended mode is configured to be enabled for inhibiting operation of the imminent motion notification apparatus.

12. The portable electronic device of claim 1, wherein the portable electronic device comprises an in-vehicle device.

13. The portable electronic device of claim 1, wherein the portable electronic device comprises a portable user device.

14. The portable electronic device of claim 1, wherein the user interface is operable to receive an input from a user indicating that the first and second testing protocols are completed.

15. A remote server computer for facilitating operation of a plurality of movable barrier operator systems, the remote server computer comprising:

a processor;

a memory operably coupled to the processor; and a network interface operably coupled to the processor and the memory, the network interface configured to communicate with a plurality of remote controls and the plurality of movable barrier operator systems via a network, the network interface configured to:

receive a confirmation indicative of a result of a plurality of testing protocols, the plurality of testing protocols including at least a first testing protocol for testing an optical sensor associated with a particular movable barrier operator system of the plurality of movable barrier operator systems and a second testing protocol for testing a force reversal sensor associated with the particular movable barrier operator system;

wherein the processor is configured to:

upon the network interface receiving the confirmation, and upon receiving a state change request from a remote control associated with the particular movable barrier operator system, cause the network interface to communicate an attended state change command to the particular movable barrier operator system, the attended state change command configured to effect a state change of a movable barrier associated with the particular movable barrier operator system and inhibit operation of an imminent motion notification apparatus of the particular movable barrier operator system; and upon the network interface not receiving the confirmation, and upon receiving the state change request from the remote control, cause the network interface to communicate an unattended state change command to the particular movable barrier operator system, the unattended state change command configured to effect a state change of the movable barrier associated with the particular movable barrier operator system and cause operation of the imminent motion notification apparatus.

16. The remote server computer of claim 15, wherein the network interface is configured to receive the confirmation from the particular movable barrier operator system.

17. The remote server computer of claim 15, wherein the confirmation includes a first confirmation indicating completion of the first testing protocol and a second confirmation indicating completion of the second testing protocol.

18. The remote server computer of claim 15, wherein the processor is configured to store an indication in the memory upon receipt of the confirmation, the indication associated with a user account of the particular movable barrier operator system.

19. The remote server computer of claim 18, wherein the processor is configured to determine whether the indication is stored in the memory upon the network interface receiving the state change request, and wherein the processor is further configured to:

communicate the attended state change command upon the network interface receiving the confirmation, the network interface receiving the state change request from the remote control, and the processor determining that the indication is stored in the memory; and communicate the unattended state change command upon the network interface not receiving the confirmation, the network interface receiving the state change request from the remote control, and the processor determining that the indication is not stored in the memory.

20. The remote server computer of claim 18, wherein the processor is further configured to remove the indication associated with the user account after a predetermined period of time.

21. The remote server computer of claim 18, wherein the processor is further configured to remove the indication associated with the user account based at least in part on receipt, by the network interface, of a threshold number of obstructions detected by the particular movable barrier operator system.

22. A non-transitory computer readable medium having instructions stored thereon that, when executed, cause performance of operations comprising:

at a remote server computer:

receiving, at a network interface of the remote server computer, a state change request from a remote control to change a state of a movable barrier associated with a movable barrier operator system;

determining, via a processor of the remote server computer, whether a confirmation has been received, the confirmation indicating that an optical sensor of the movable barrier operator system has been tested using a first testing protocol and that a force reversal sensor of the movable barrier operator system has been tested using a second testing protocol;

communicating, via the network interface of the remote server computer, an attended state change command to the movable barrier operator system in response to the network interface receiving the state change request and the processor determining that the confirmation has been received, the attended state change command configured to inhibit operation of an imminent motion notification apparatus in connection with a change of state of the movable barrier; and communicating, via the network interface, an unattended state change command to the movable barrier operator system in response to the network interface receiving the state change request and the processor determining that the confirmation has not been received, the unattended state change command configured to cause operation of the imminent motion notification apparatus in connection with the change of state of the movable barrier.

23. The non-transitory computer readable medium of claim 22, wherein the movable barrier operator system is associated with a user account, the operations further comprising:

determining, via the processor, whether an attended mode of the user account has been enabled; and wherein communicating the unattended state change command includes the network interface communicating the unattended state change command to the movable barrier operator system in response to the network interface receiving the state change request, the processor determining the confirmation has not been received, and the processor determining that the attended mode has not been enabled.

24. The non-transitory computer readable medium of claim 22, wherein the movable barrier operator system is associated with a user account, the operations further comprising:

upon receipt of the confirmation, storing an indication for the user account in a memory of the remote server computer.

25. The non-transitory computer readable medium of claim 24, the operations further comprising:

removing the indication associated with the user account upon the movable barrier operator system detecting a threshold number of obstructions.

26. The non-transitory computer readable medium of claim 24, the operations further comprising:

removing the indication associated with the user account after a predetermined period of time.

* * * * *